US006840390B2

(12) United States Patent
Thomas

(10) Patent No.: US 6,840,390 B2
(45) Date of Patent: Jan. 11, 2005

(54) CONTAINER RACKING SYSTEM AND METHOD

(75) Inventor: John E. Thomas, River Falls, WI (US)

(73) Assignee: Ecolab Inc., St. Paul, MN (US)

( * ) Notice: Subject to any disclaimer, the term of this patent is extended or adjusted under 35 U.S.C. 154(b) by 95 days.

(21) Appl. No.: 10/429,488

(22) Filed: May 5, 2003

(65) Prior Publication Data

US 2004/0222173 A1 Nov. 11, 2004

(51) Int. Cl.[7] ..... A47F 5/00

(52) U.S. Cl. ..... 211/71.01; 211/59.1; 206/804; 220/DIG. 2; 220/DIG. 15

(58) Field of Search ..... 211/74, 71.01, 211/59.1; 206/804; 220/DIG. 2, DIG. 15; 141/18, 247; 414/416.12

(56) References Cited

U.S. PATENT DOCUMENTS 1,933,596 A * 11/1933 Showles ..... 426/115
2,630,924 A * 3/1953 Vacanti ..... 211/85.7
2,964,210 A * 12/1960 Paley ..... 220/4.33
3,002,650 A * 10/1961 Lovell ..... 206/509
3,403,714 A * 10/1968 Hulm ..... 221/260
3,762,594 A * 10/1973 Utz ..... 220/516
3,780,892 A * 12/1973 Frank ..... 414/811
3,926,323 A * 12/1975 Frank et al. ..... 414/416.07
4,490,087 A * 12/1984 Ryan et al. ..... 414/416.12

* cited by examiner

*Primary Examiner*—Robert W. Gibson, Jr.
(74) *Attorney, Agent, or Firm*—IPLM Group, P.A.

(57) ABSTRACT

A container racking system for a plurality of refillable containers. A crate has a bottom and side walls arranged to secure the plurality of refillable containers in a position when the plurality of refillable containers are placed into the crate. The bottom of the crate has at least one opening positioned below at least one of the plurality of refillable containers. A rack holds the crate when it is desired to have the plurality of refillable containers available for refilling. The rack is capable of supporting the crate when the crate is placed on the rack. At least one member is positioned within the rack such that the at least one member protrudes through the at least one opening of the bottom of the crate when the crate is placed on the rack. In this way, at least one of the plurality of refillable containers is raised up from the bottom of the crate when the crate is placed on the rack making the at least one of the plurality of refillable containers readily available for refilling.

9 Claims, 3 Drawing Sheets

CONTAINER RACKING SYSTEM AND METHOD

TECHNICAL FIELD

The present invention relates generally to racking systems for containers and, more particularly, to racking systems for containers which are refillable, and to methods of refilling such containers.

BACKGROUND

Certain industries, e.g., cleaning and food & beverage industries, utilize containers which contain a substance, usually a fluid, typically used in the particular industry. As an example, a liquid cleaning product may be placed in a spray bottle.

Multiple spray bottles may be used in a single commercial establishment and such containers, or spray bottles, may be placed in crates to store and stack the multiple containers.

It is desirable to stack crates to allow an efficient use of storage space. One mechanism to allow stacking is for sides of the crate to be as high as height of containers contained therein. This would then allow a plurality of crates, each possibly holding a plurality of containers, to be stacked vertically.

In certain circumstances, it may by desirable to be able to reuse such containers. This can be advantageous both from a cost point of view and from an environmental point of view.

Further, it may be desirable to able to manipulate containers, such as in a refilling operation. However, as an example, with the sides of the crate being as high as the containers in the crate, it may be difficult to gain access to containers and be able to easily manipulate them in the refilling operation.

SUMMARY OF THE INVENTION

In one embodiment, the present invention provides a racking system which not only secures containers capable of being refilled, it also crates a plurality of containers for efficient stacking and allows easy access to the containers for manipulation, such as for refilling.

In one embodiment, the present invention provides a container racking system for a plurality of refillable containers. A crate having a bottom and having side walls is arranged to secure the plurality of refillable containers in a position when the plurality of refillable containers are placed into the crate. The bottom of the crate has at least one opening positioned below at least one of the plurality of refillable containers. A rack holds the crate when it is desired to have the plurality of refillable containers available for refilling, the rack being capable of supporting the crate when the crate is placed on the rack. At least one member is positioned within the rack such that the at least one member protrudes through the at least one opening of the bottom of the crate when the crate is placed on the rack whereby at least one of the plurality of refillable containers is raised up from the bottom of the crate when the crate is placed on the rack making the at least one of the plurality of refillable containers readily available for refilling.

In another embodiment, the present invention provides a container racking system for a plurality of refillable containers. A crate has a bottom and has side walls arranged to secure the plurality of refillable containers when the plurality of refillable containers are placed into position in the crate. The bottom of the crate has a plurality of openings, one for each of the plurality of refillable containers, each of the plurality of openings being positioned below each of the plurality of refillable containers. A rack holds the crate when it is desired to have the plurality of refillable containers available for refilling, the rack being capable of supporting the crate when the crate is placed on the rack. A plurality of members are positioned within the rack such that the plurality of members protrude through the plurality of openings in the bottom of the crate when the crate is placed on the rack whereby the plurality of refillable containers are raised up from the bottom of the crate when the crate is placed on the rack making the plurality of refillable containers readily available for refilling.

In a further embodiment, the plurality of refillable containers have a top, a bottom and a height, the side walls of the crate have a top edge and the top edge of the side walls are at least as high as the height of the plurality of refillable containers allowing a plurality of the crates to be stacked on top of each other when containing at least one of the plurality of refillable containers. The at least one member of the rack protrudes a distance through the at least one opening such that the at least one member pushes against the bottom of at least one of the plurality of refillable containers such that the top of the at least one of the plurality of refillable containers is raised above the top edge of the side walls of the crate.

In another embodiment, the present invention provides a method of preparing a plurality of refillable containers, contained in a rack, for refilling. The method uses a container racking system having a crate having a bottom and having side walls arranged to secure the plurality of refillable containers in a position when the plurality of refillable containers are placed into position in the crate. The bottom of the crate has at least one opening positioned below the position of at least one the plurality of refillable containers. A rack holds the crate when it is desired to have the plurality of refillable containers available for refilling, the rack being capable of supporting the crate when the crate is placed on the rack. At least one member is positioned within the rack such that the at least one member protrudes through the at least one opening of the bottom of the crate when the crate is placed on the rack. The method comprises the steps of placing at least one of the plurality of refillable containers in position in the crate and placing the crate containing the at least one of the plurality of refillable containers on the rack whereby at least one of the plurality of refillable containers is raised up from the bottom of the crate when the crate is placed on the rack making the at least one of the plurality of refillable containers readily available for refilling.

BRIEF DESCRIPTION OF THE DRAWING

The foregoing advantages, construction and operation of the present invention will become more readily apparent from the following description and accompanying drawings in which.

DETAILED DESCRIPTION

Figure 1:
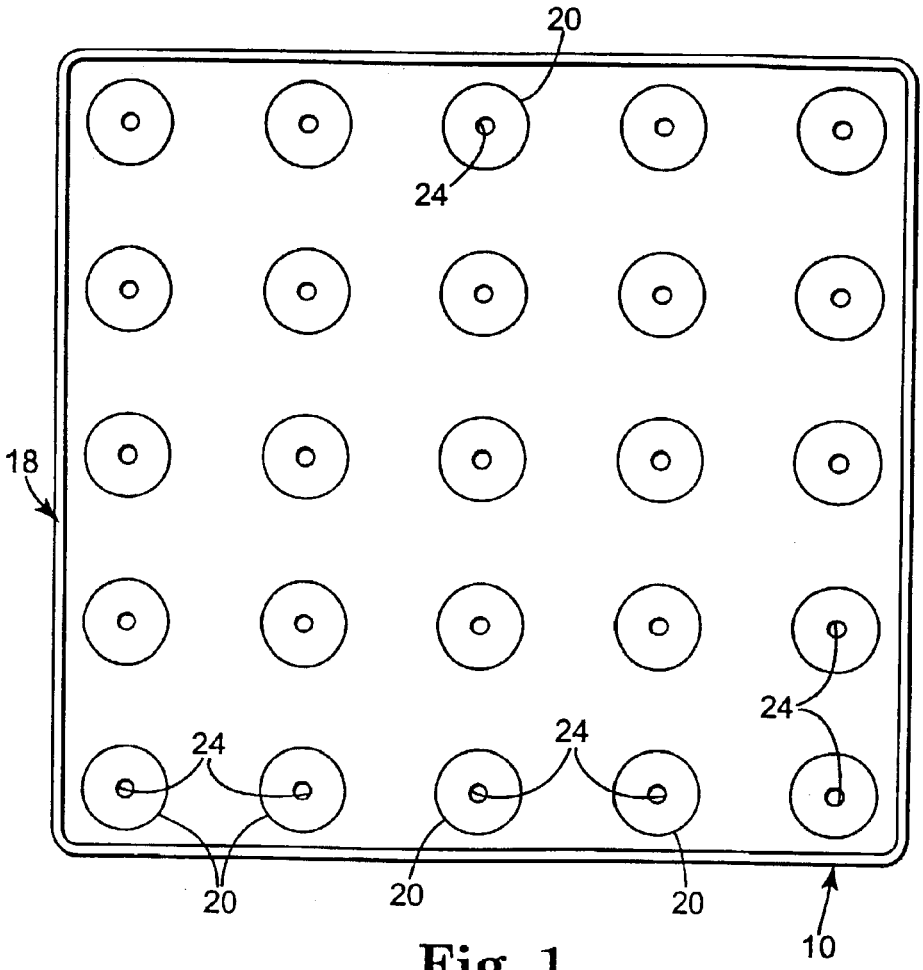
FIG. 1 is a top view of a crate constructed according to an embodiment of the present invention.

FIG. 1 illustrates a top view of crate 10 capable of holding a plurality of containers 12 (not shown in FIG. 1), each in a position 20. Crate 10 has side walls 14 and bottom 16. Side walls 14 have top edges 18. The top of crate 10 is open to accommodate the loading, unloading and manipulation of containers 12.

While crate 10 is illustrated in FIG. 1 to hold twenty-five containers 12 in five rows of five, it is to be recognized and understood that such a number and configuration of containers 12 is merely exemplary and any other number, arrangement or position of containers 12 is possible. Crate 10 may be relatively square, as shown, or may be rectangular, circular or any other shape. Side walls 14 may be solid or may have one or more openings to reduce material used and to save weight. In an embodiment, at least a portion of side walls 14 be of a height such that top edges 18 come up to at least the height of containers 12 when containers 12 are placed into crate 10. The reason that such a height is preferable is so that a plurality of crates 10, each with the possibility of holding containers 12 may be stacked one on top of another facilitating an efficient storage arrangement.

Each container 12 is designed to fit in a position 20. Position 20 can be defined by being a separate compartment, e.g., separated from other positions 20 by full or partial internal walls, by depressions formed in bottom 16, by simply being positioned at the time of loading, being forced into a position by virtue of the number of containers 12 placed in crate 10, or any number of other techniques.

Each container 12 can hold either a liquid product or a solid product as dictated by its intended use. In an embodiment, container 12 holds a liquid product, such as a cleaning product, in a conventional spray bottle.

As illustrated in FIG. 1, bottom 16 of crate 10 has an opening 24 located at each position 20 for each container 12. As shown, opening 24 is simply a round hole or a cutout in bottom 16 of crate 10. While shown as a round hole, it is to be recognized and understood that opening 24 could be any of a number of different shapes and sizes. Also, while FIG. 1 illustrates an individual opening 24 for each position 20 in crate 10, it is to be recognized and understood that many other variations are possible. Without limitation, opening 24 may be continuous across a plurality of positions 20 or continuous across an entire row or column of positions 20. In an embodiment, it is also possible that crate 10 have a bottom 16 which is entirely composed of an opening 24 encompassing all, nearly all of the effective area of what would otherwise be the bottom of crate 10. In this case it is preferable that some means is provided to hold containers 12 in crate 10, possibly rings, or other mechanism, attached to side walls 14 of crate 10.

Figure 2:
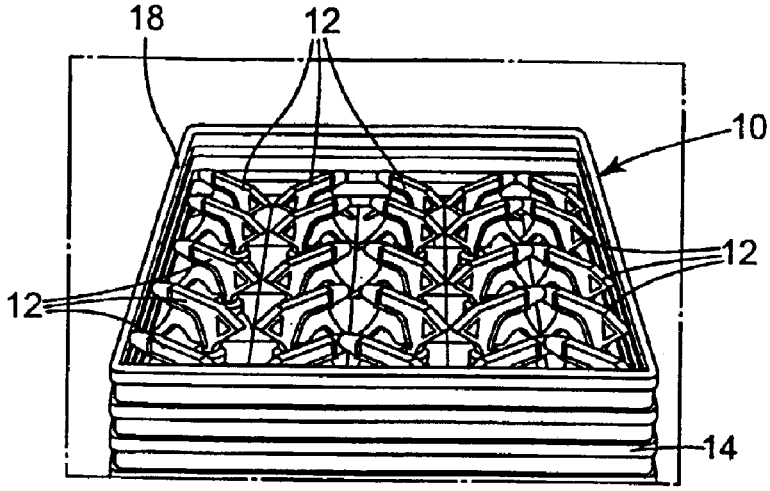
FIG. 2 is a perspective view of the top of the rack of FIG. 1 holding a plurality of containers.

FIG. 2 shows a perspective view of the crate 10 of FIG. 1 with a full load of containers 12. Each container 12 is located in a position in crate 10. As illustrated, containers 12 are spray bottles intended to hold a liquid, such as a liquid cleanser, however, it is to be recognized and understood that the illustration of containers 12 as spray bottles is merely exemplary. Containers 12 may be any container suitable for holding a product, liquid or solid, to be stored or used.

Containers 12 are held securely in crate 10 and, in an embodiment, side walls 14 have top edges 18 which are high enough to allow a plurality of crates 10 to be stacked on top of one another.

However, it can be seen in FIG. 2 that containers 12 are located relatively deep within side walls 14 of crate 10. This deep location makes difficult to manipulate containers 12 while containers 12 are being held in crate 10 as, for example, during a refilling operation.

Figure 3:
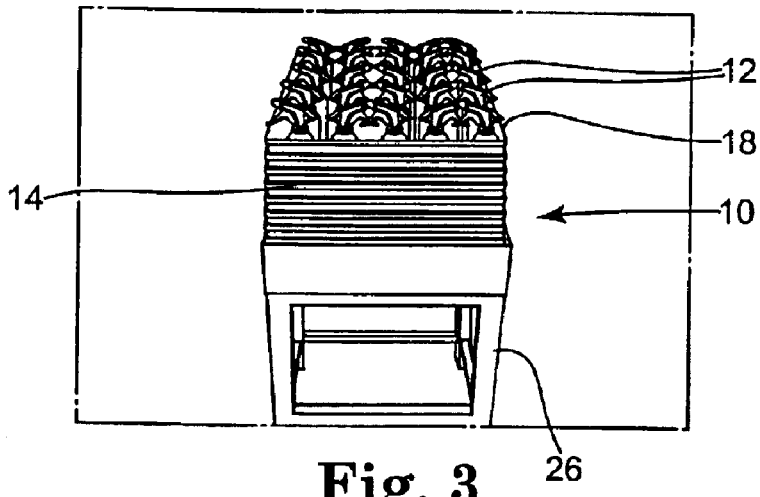
FIG. 3 is a perspective view of a rack constructed according to an embodiment of the present invention.
Figure 4:
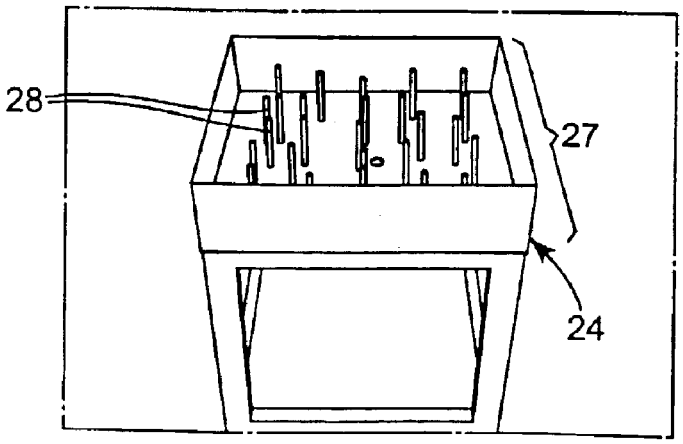
FIG. 4 is a close-up view of the top of the rack of FIG. 3 showing internal protrusions in accordance with an embodiment of the present invention.

FIGS. 3 and 4 illustrate a perspective view of rack 26. Rack 26 can stand alone on the floor, for example. Rack 26 has an upper area 27 arranged and sized to accommodate the lower portion of crate 10 allowing crate 10 to sit on or in rack 26 when crate 10 is placed on rack 26. In an embodiment, rack 26 holds crate 10 above floor level at a convenient working level for performing manipulations on containers 12 held in crate 10.

Internal members 28 are raised protrusions, or elongate rods, located in the interior of rack 26 projecting from the bottom of rack 26. Internal members 28 are configured to mate with openings 24 in crate 10 when crate 10 is placed on or into rack 26. In an embodiment, there is an equal number of openings 24 and internal members 28.

Figure 5:
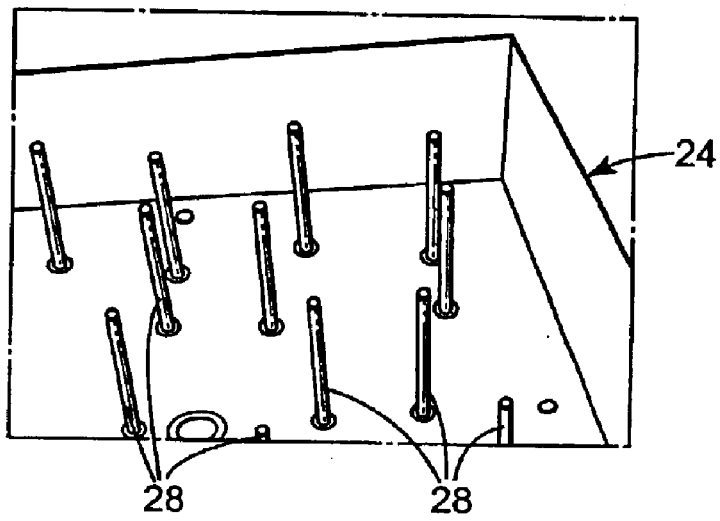
FIG. 5 is perspective view of the crate of FIG. 2 placed onto the rack of FIG. 3 in accordance with an embodiment of the present invention.
Figure 6:
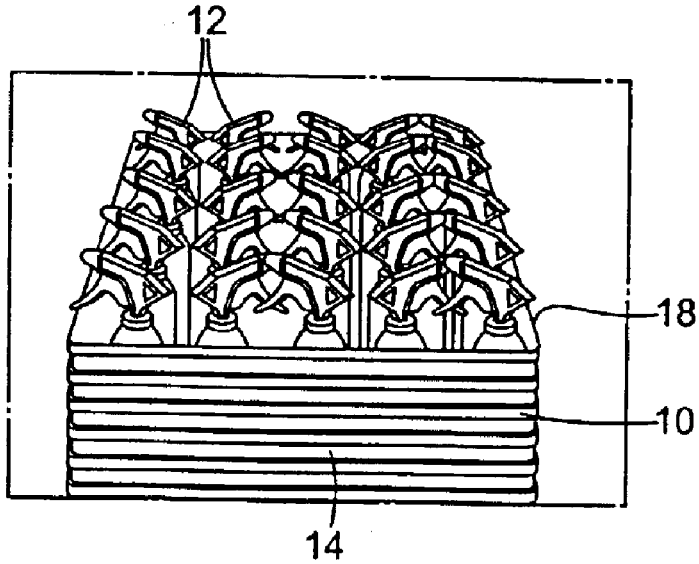
FIG. 6 is a close-up view of the crate of FIG. 2 placed a rack as in FIG. 5 showing the raised position of the containers.

FIGS. 5 and 6 show crate 10 filled with containers 12 placed onto rack 26. Internal members 28 of rack 26 mate with openings 24 of crate 10 as crate 10 is placed onto rack 26. As internal members 28 project into openings 24, containers 12 are lifted from their positions 20 and elevated to a raised position due to internal members 28. In an embodiment, with crate 10 sitting on or in rack 26, containers 12 are raised to a higher position with respect to side walls 14 of crate such that top edges 18 of crate 10 are below the top of containers 12. Such a raised position allows easy manipulation of containers 12, such as a filling or re-filling operation.

Once the manipulation to containers 12 is completed, such as when filling or re-filling is completed, crate 10 may simply be removed from rack 26 and either placed on the floor, a shelf or other stored, shipped or used with containers 12 again safely secured deep within crate 10.

Thus, in order to manipulate containers 12, one or more containers 12 is/are placed into position in crate 10. Crate 10 is then placed on rack 26 automatically raising containers 12 in crate 10 making containers 12 readily available for refilling.

Thus, the combination of crate 10 and rack 26, arranged with containers 12, contribute to a reduction in labor and saving in time by facilitating the easy manipulation of containers 12.

While the embodiment described has internal members 28 which raise containers 12 by pushing on the bottom of containers 12 when crate 10 is placed onto rack 26, it is to be recognized and understood that internal members may be arranged to lift any other part of containers 12, either directly or indirectly, as internal members 28 mate with openings 24.

In embodiments, containers 12 may be filled or re-filled through the use of gravity feed, direct fill, via a pump and by direct fill with a pump and a water flow system. Other methods and means for filling or re-filling containers 12 are also contemplated.

Various modifications and alterations of this invention will be apparent to those skilled in the art without departing from the scope and spirit of this invention. It should be understood that this invention is not limited to the illustrative embodiments set forth above.

What is claimed is:

1. A container racking system for a plurality of refillable containers, comprising:

a crate having a bottom and having side walls arranged to secure said plurality of refillable containers in a position when said plurality of refillable containers are placed into said crate;

said bottom of said crate having at least one opening positioned below at least one of said plurality of refillable containers;

a rack for holding said crate when it is desired to have said plurality of refillable containers available for refilling, said rack being capable of supporting said crate when said crate is placed on said rack; and at least one member positioned within said rack such that said at least one member protrudes through said at least one opening of said bottom of said crate when said crate is placed on said rack;

whereby at least one of said plurality of refillable containers is raised up from said bottom of said crate when said crate is placed on said rack making said at least one of said plurality of refillable containers readily available for refilling.

2. A container racking system as in claim 1:

wherein said plurality of refillable containers have a top, a bottom and a height;

wherein said side walls of said crate have a top edge and wherein said top edge of said side walls are at least as high as said height of said plurality of refillable containers allowing a plurality of said crates to be stacked on top of each other when containing at least one of said plurality of refillable containers; and wherein said at least one member of said rack protrudes a distance through said at least one opening such that said at least one member pushes against said bottom of at least one of said plurality of refillable containers such that said top of said at least one of said plurality of refillable containers is raised above said top edge of said side walls of said crate.

3. A container racking system as in claim 2 wherein said crate has a plurality of said openings, one of said openings for each of said plurality of containers.

4. A container racking system for a plurality of refillable containers, comprising:

a crate having a bottom and having side walls arranged to secure said plurality of refillable containers when said plurality of refillable containers are placed into position in said crate;

said bottom of said crate having a plurality of openings, one for each of said plurality of refillable containers, each of said plurality of openings positioned below each of said plurality of refillable containers;

a rack for holding said crate when it is desired to have said plurality of refillable containers available for refilling, said rack being capable of supporting said crate when said crate is placed on said rack; and a plurality of members positioned within said rack such that said plurality of members protrude through said plurality of openings in said bottom of said crate when said crate is placed on said rack;

whereby said plurality of refillable containers are raised up from said bottom of said crate when said crate is placed on said rack making said plurality of refillable containers readily available for refilling.

5. A container racking system as in claim 4:

wherein said plurality of refillable containers have a top, a bottom and a height;

wherein said side walls of said crate have a top edge and wherein said side walls are at least as high as said height of said plurality of refillable containers allowing a plurality of said crates to be stacked on top of each other when containing at least one of said plurality of refillable containers; and wherein said plurality of members of said rack protrudes a distance through said plurality of openings such that said plurality of members push against said bottom of said plurality of refillable containers such that said top of said plurality of refillable containers is raised above said top edge of said side walls of said crate.

6. A container racking system as in claim 5 which has one of said plurality of openings for each of said plurality of containers.

7. A method of preparing a plurality of refillable containers, contained in a rack, for refilling, using a container racking system having a crate having a bottom and having side walls arranged to secure said plurality of refillable containers in a position when said plurality of refillable containers are placed into position in said crate;

said bottom of said crate having at least one opening positioned below said position of at least one said plurality of refillable containers;

a rack for holding said crate when it is desired to have said plurality of refillable containers available for refilling, said rack being capable of supporting said crate when said crate is placed on said rack; and at least one member positioned within said rack such that said at least one member protrudes through said at least one opening of said bouom of said crate when said crate is placed on said rack;

comprising the steps of:

placing at least one of said plurality of refillable containers in position in said crate; and placing said crate containing said at least one of said plurality of refillable containers on said rack;

whereby at least one of said plurality of refillable containers is raised up from said bottom of said crate when said crate is placed on said rack making said at least one of said plurality of refillable containers readily available for refilling.

8. A method of preparing a plurality of refillable containers as in claim 7:

wherein said plurality of refillable containers have a top, a bottom and a height;

wherein said side walls of said crate have a top edge and wherein said top edge of said side walls are at least as high as said height of said plurality of refillable containers allowing a plurality of said crates to be stacked on top of each other when containing at least one of said plurality of refillable containers; and wherein said at least one member of said rack protrudes a distance through said at least one opening such that said at least one member pushes against said bottom of at least one of said plurality of refillable containers such that said top of said at least one of said plurality of refillable containers is raised above said top edge of said side walls of said crate.

9. A method of preparing a plurality of refillable containers as in claim 8 wherein said crate has a plurality of said openings, one of said openings for each of said plurality of containers.

* * * * *